US009335646B2

(12) United States Patent
Kaku et al.

(10) Patent No.: US 9,335,646 B2
(45) Date of Patent: May 10, 2016

(54) ELECTROPHOTOGRAPHIC PHOTOSENSITIVE MEMBER, METHOD OF PRODUCING ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Kenichi Kaku, Newcastle Upon Tyne (GB); Wataru Kitamura, Abiko (JP); Yuka Ishiduka, Suntou-gun (JP); Mai Murakami, Kashiwa (JP); Ryoichi Tokimitsu, Kashiwa (JP); Hideaki Nagasaka, Suntou-gun (JP); Takeshi Murakami, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 43 days.

(21) Appl. No.: 14/361,624

(22) PCT Filed: Nov. 28, 2012

(86) PCT No.: PCT/JP2012/081430
§ 371 (c)(1),
(2) Date: May 29, 2014

(87) PCT Pub. No.: WO2013/081170
PCT Pub. Date: Jun. 6, 2013

(65) Prior Publication Data

US 2015/0004534 A1 Jan. 1, 2015

(30) Foreign Application Priority Data

Nov. 30, 2011 (JP) ..... 2011-262121
Nov. 21, 2012 (JP) ..... 2012-254809

(51) Int. Cl.
*G03G 5/00* (2006.01)
*G03G 5/14* (2006.01)
*B05D 3/02* (2006.01)

(52) U.S. Cl.
CPC ..... *G03G 5/144* (2013.01); *B05D 3/0254* (2013.01); *G03G 5/142* (2013.01)

(58) Field of Classification Search
CPC ..... G03G 5/144
USPC ..... 430/60, 65
See application file for complete search history.

(56) References Cited

U.S. PATENT DOCUMENTS

2008/0187846 A1* 8/2008 Takimoto et al. ..... 430/56

FOREIGN PATENT DOCUMENTS

JP 2003-186219 A 7/2003
JP 2004-226751 A 8/2004

(Continued)

*Primary Examiner* — Mark A Chapman
(74) *Attorney, Agent, or Firm* — Canon U.S.A. Inc., IP Division

(57) ABSTRACT

Provided are an electrophotographic photosensitive member in which a variation in the light-area potential is suppressed even when the electrophotographic photosensitive member is repeatedly used for a long time in a high-temperature, high-humidity environment, a method of producing the electrophotographic photosensitive member, and a process cartridge and an electrophotographic apparatus that include the electrophotographic photosensitive member. The electrophotographic photosensitive member includes a support, an undercoat layer, and a photosensitive layer, wherein the undercoat layer contains a urethane resin and zinc oxide particles whose surfaces have been treated with a particular amount of an aminosilane compound.

8 Claims, 3 Drawing Sheets

(56) References Cited

FOREIGN PATENT DOCUMENTS

| | | | |
|---|---|---|---|
| JP | 2005-309358 | A | 11/2005 |
| JP | 2006-030700 | A | 2/2006 |
| JP | 2006-259141 | A | 9/2006 |
| JP | 2008-046420 | A | 2/2008 |
| JP | 2008-065171 | A | 3/2008 |
| JP | 2009-098484 | A | 5/2009 |
| JP | 2012-073353 | A | 4/2012 |
| JP | 2012-203242 | A | 10/2012 |

* cited by examiner

ELECTROPHOTOGRAPHIC PHOTOSENSITIVE MEMBER, METHOD OF PRODUCING ELECTROPHOTOGRAPHIC PHOTOSENSITIVE MEMBER, PROCESS CARTRIDGE, AND ELECTROPHOTOGRAPHIC APPARATUS

TECHNICAL FIELD

The present invention relates to an electrophotographic photosensitive member, a method of producing an electrophotographic photosensitive member, a process cartridge, and an electrophotographic apparatus.

BACKGROUND ART

An electrophotographic photosensitive member (organic electrophotographic photosensitive member) including an undercoat layer containing metal oxide particles and a photosensitive layer formed on the undercoat layer and containing a charge-generating substance and a charge-transporting substance is used in electrophotographic apparatuses.

For example, titanium oxide particles, tin oxide particles, and zinc oxide particles are used as the metal oxide particles. In particular, it is known that the resistance of zinc oxide particles easily changes depending on the degree of oxygen deficiency and that the larger the oxygen deficiency, the lower the resistance of the zinc oxide particles.

These metal oxide particles are subjected to a surface treatment with a silane coupling agent in order to suppress the generation of black spot-like image defects caused by charge injection from a support to the photosensitive layer side. However, when the undercoat layer contains such surface-treated metal oxide particles, the resistance of the undercoat layer is increased and a variation in the electric potential (such as a variation in the light-area potential) in repeated use tends to be significant.

As for a technology for suppressing a variation in the light-area potential, PTL 1 discloses a technology in which zinc oxide particles provided with an acceptor compound (organic compound) are incorporated in an undercoat layer of an electrophotographic photosensitive member. PTL 2 discloses a technology in which a plurality of undercoat layers each contain a silane coupling agent, and one of the undercoat layers disposed on the photosensitive layer side has a higher concentration of the silane coupling agent.

CITATION LIST

Patent Literature

PTL 1 Japanese Patent Laid-Open No. 2006-30700
PTL 2 Japanese Patent Laid-Open No. 2008-065171

SUMMARY OF INVENTION

Technical Problem

However, in a high-humidity environment, moisture in the atmosphere etc. easily adhere to the surfaces of zinc oxide particles and oxygen deficiency is inactivated, resulting in an increase in the resistance of the zinc oxide particles. Furthermore, with the recent realization of a high process speed of electrophotographic apparatuses, a potential variation in long-term repeated use tends to occur in a high-humidity environment. As a result of examinations conducted by the inventors of the present invention, it was found that, in particular, a potential variation in long-term repeated use tends to significantly occur in a high-temperature, high-humidity environment (for example, a high-temperature, high-humidity environment at 30° C./85% RH or more). When the potential variation is large in long-term repeated use, developability of a toner changes and thus the image density tends to change. The undercoat layers described in PTL 1 and PTL 2 have a problem in that a potential variation tends to occur in long-term repeated use in a high-temperature, high-humidity environment.

The present invention provides an electrophotographic photosensitive member in which a variation in the light-area potential is suppressed even when the electrophotographic photosensitive member is repeatedly used for a long time in a high-temperature, high-humidity environment, a method of producing the electrophotographic photosensitive member, and a process cartridge and an electrophotographic apparatus that include the electrophotographic photosensitive member.

Solution to Problem

According to a first aspect of the present invention, an electrophotographic photosensitive member includes a support; an undercoat layer formed on the support; and a photosensitive layer formed on the undercoat layer, wherein the undercoat layer contains a urethane resin, and zinc oxide particles whose surfaces have been treated with a compound represented by the following formula (2), when a ratio of the mass of the compound represented by the formula (2) relative to the mass of the zinc oxide particles is A mass %, and a specific surface area of the zinc oxide particles is B $m^2/g$, the amount of surface treatment which is defined as A/B satisfies the following formula (1), and the value of B is from 14 to 25.

$$0.010 \leq A/B \leq 0.050 \quad (1)$$

(2)

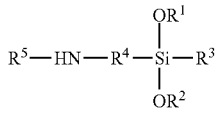

In the formula (2), $R^1$ and $R^2$ each independently represent an alkyl group having 1 to 3 carbon atoms, $R^3$ represents an alkyl group having 1 to 3 carbon atoms or an alkoxy group having 1 to 3 carbon atoms, $R^4$ represents a bivalent group represented by the following formula (R4-1), (R4-2) or (R4-3), and $R^5$ represents a hydrogen atom, a phenyl group, or an alkyl group having 1 to 3 carbon atoms.

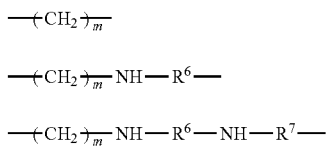

(R4-1)

(R4-2)

(R4-3)

In the formulas (R4-1), (R4-2) and (R4-3), m is an integer number selected from 1 to 3, and $R^6$ and $R^7$ each independently represent an alkylene group having 1 to 4 carbon atoms.

According to a second aspect of the present invention, a method of producing the electrophotographic photosensitive member includes the steps of forming a coat for the undercoat layer by using an undercoat layer coating solution; and forming the undercoat layer by heat-drying of the coat, wherein the undercoat layer coating solution contains a compound having one or more isocyanate groups, a polyol resin, and the zinc oxide particles whose surfaces have been treated with the compound represented by the formula (2).

According to a third aspect of the present invention, a process cartridge is detachably attachable to a main body of an electrophotographic apparatus, wherein the process cartridge integrally supports the electrophotographic photosensitive member, and at least one device selected from the group consisting of a charging device, a developing device, a transferring device, and a cleaning device.

According to a fourth aspect of the present invention, an electrophotographic apparatus includes the electrophotographic photosensitive member, a charging device, an exposure device, a developing device, and a transferring device.

Advantageous Effects of Invention

According to the first aspect of the present invention, it is possible to provide an electrophotographic photosensitive member in which a variation in the light-area potential is effectively suppressed even when the electrophotographic photosensitive member is repeatedly used for a long time in a high-temperature, high-humidity environment. According to the second aspect of the present invention, a method of producing the above electrophotographic photosensitive member can be provided. According to the third and fourth aspects of the present invention, a process cartridge and an electrophotographic apparatus that include the electrophotographic photosensitive member can be provided.

DESCRIPTION OF EMBODIMENTS

Figure 1:
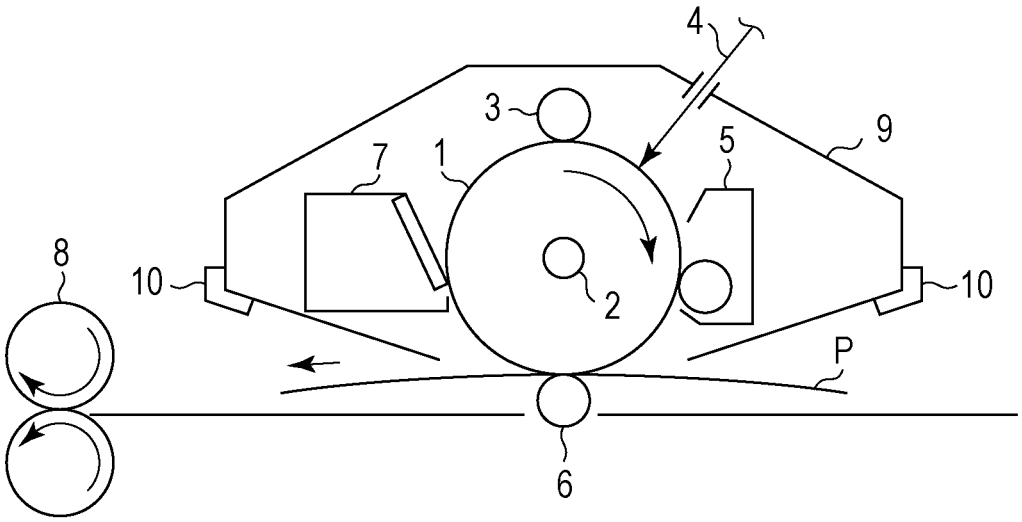
FIG. 1 is a view illustrating an example of a schematic structure of an electrophotographic apparatus including a process cartridge having an electrophotographic photosensitive member according to an embodiment of the present invention.

An electrophotographic photosensitive member according to an embodiment of the present invention includes a support, an undercoat layer formed on the support, and a photosensitive layer formed on the undercoat layer, wherein the undercoat layer contains a urethane resin, and zinc oxide particles whose surfaces have been treated with a compound represented by the following formula (2), when a ratio (mass %) of the mass of the compound represented by the formula (2) relative to the mass of the zinc oxide particles is A, and a specific surface area ($m^2/g$) of the zinc oxide particles is B, the amount of surface treatment which is defined as A/B satisfies the following formula (1), and the value of B is from 14 to 25.

$$0.010 \leq A/B \leq 0.050 \quad (1)$$

When the value of B is less than 14, the resistance of the undercoat layer tends to be lowered, and the light-area potential in repeated use tends to vary. When the valued of B is larger than 25, film defects such as cracks are easily generated in the undercoat layer.

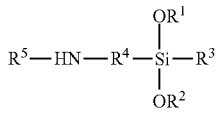

(2)

In the formula (2), $R^1$ and $R^2$ each independently represent an alkyl group having 1 to 3 carbon atoms, $R^3$ represents an alkyl group having 1 to 3 carbon atoms or an alkoxy group having 1 to 3 carbon atoms, $R^4$ represents a bivalent group represented by the following formula (R4-1), (R4-2) or (R4-3), and $R^5$ represents a hydrogen atom, a phenyl group, or an alkyl group having 1 to 3 carbon atoms.

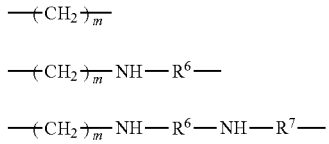

(R4-1)

(R4-2)

(R4-3)

In the formulas (R4-1), (R4-2) and (R4-3), m is an integer number selected from 1 to 3, and $R^6$ and $R^7$ each independently represent an alkylene group having 1 to 4 carbon atoms.

In the present invention, a variation in the light-area potential in repeated use of an electrophotographic photosensitive member in a high-temperature, high-humidity environment is effectively suppressed by incorporating zinc oxide particles whose surfaces have been treated with a compound represented by the formula (2) so as to satisfy the formula (1) in an undercoat layer of the electrophotographic photosensitive member. The inventors of the present invention believe the reason for this is as follows.

Zinc oxide particles carry electrons on the basis of oxygen deficiency of the zinc oxide particles. In a high-temperature, high-humidity environment, a large amount of moisture is contained in the atmosphere. Thus, when zinc oxide particles are exposed to a high-humidity environment once, oxygen deficiency of the zinc oxide particles are lost by adsorption of moisture and the like, thereby decreasing the electron-carrying property. Specifically, the resistance of the zinc oxide particles increases. On the other hand, when the amount of surface treatment with a silane coupling agent is excessively large, oxygen deficiency of zinc oxide particles is lost by a reaction with the silane coupling agent, thereby decreasing the electron-carrying property. Consequently, the resistance of the zinc oxide particles increases. Accordingly, it is important that the amount of surface treatment with a silane coupling agent be optimized so that the amount of moisture adsorbed to zinc oxide particles is reduced to stabilize (decrease) the resistance of the zinc oxide particles. Thus, a variation in the light-area potential in repeated use can be suppressed. In addition, a variation in the light-area potential in a high-temperature, high-humidity environment can also be suppressed.

Figure 3:
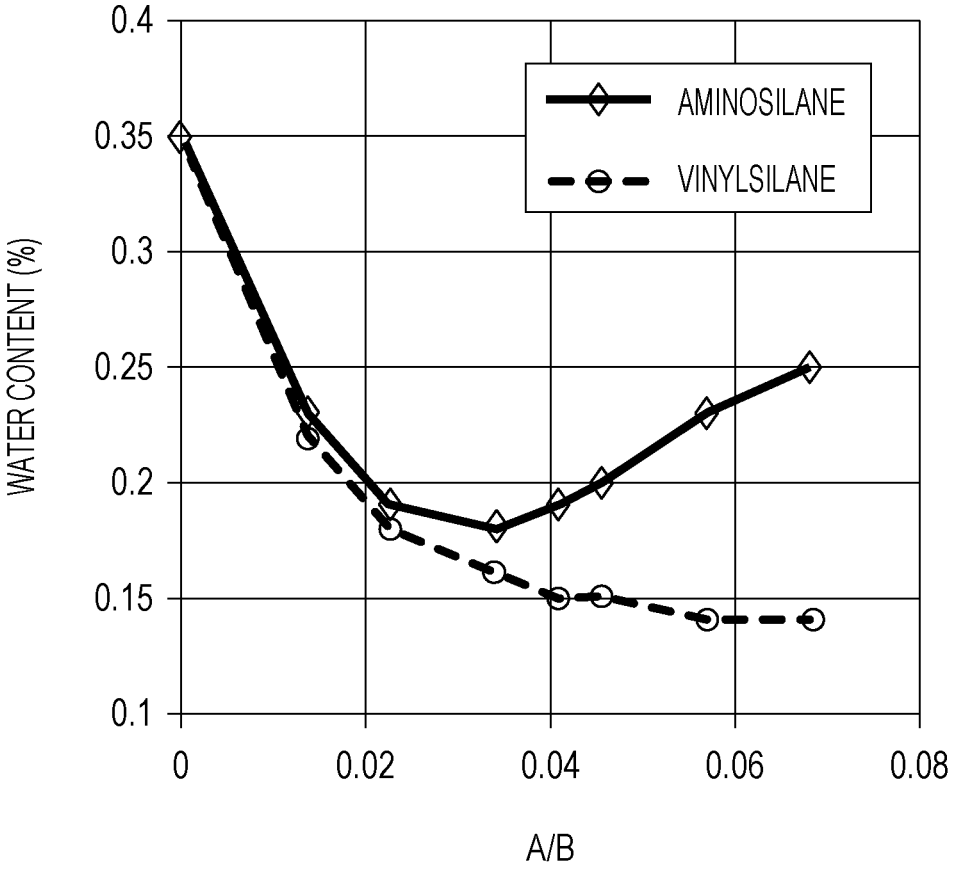
FIG. 3 is a graph showing a relationship between the amount of surface treatment and the amount of moisture contained (water content) in zinc oxide particles in the cases where zinc oxide particles having a BET value of 19 $m^2/g$ were surface-treated with N-2-(aminoethyl)-3-aminopropyltrimethoxysilane (denoted by aminosilane in FIG. 3) and vinyltrimethoxysilane (denoted by vinylsilane in FIG. 3).

In the present invention, it was found that when the amount of surface treatment with a silane coupling agent is as follows, the amount of moisture contained in zinc oxide particles can be reduced, and the effect of suppressing a variation in the light-area potential in a high-temperature, high-humidity environment can be achieved. As shown in FIG. 3, in the case of a common silane coupling agent (such as a vinylsilane), with an increase in the amount of surface treatment, the amount of moisture contained in (amount of water adsorbed to) zinc oxide particles monotonically decreases. In contrast, a compound having a structure represented by the formula (2) according to an embodiment of the present invention is an aminosilane coupling agent, and an amino group of this aminosilane coupling agent has hygroscopicity. Accordingly, with an increase in the amount of surface treatment, the amount of moisture contained in the zinc oxide particles does not monotonically decrease but increases from a certain amount of surface treatment. That is, the line showing the relationship between the amount of surface treatment and the amount of moisture shows a curve protruding downward.

In the case shown in FIG. 3 where a surface treatment is conducted with the aminosilane (compound represented by the formula (2)), the amount of moisture contained in the surface-treated zinc oxide particles is small in a region of the bottom of the curve, and thus an increase in the resistance of the zinc oxide particles due to adsorption of moisture can be suppressed. As a result, a variation in the light-area potential in repeated use in a high-temperature, high-humidity environment can be suppressed. The range represented by the above formula (1) is a range showing the region of the bottom of the curve in FIG. 3. It is believed that the advantages of the present invention can be achieved by incorporating the zinc oxide particles whose surfaces have been treated with the compound represented by the formula (2) so as to satisfy the formula (1).

In the present invention, the amount of surface treatment with the compound represented by the formula (2) satisfies the above formula (1). More preferably, the amount of surface treatment satisfies the following formula (3). In this case, a higher effect of suppressing a variation in the light-area potential in repeated use is obtained.

$$0.025 \leq A/B \leq 0.050 \quad (3)$$

Specific examples of the compound represented by the formula (2) will be described below, but the present invention is not limited thereto.

Examples of the compound represented by the formula (2) where $R^3$ is an alkoxy group having 1 to 3 carbon atoms include the compounds represented by (X-1) to (X-6) in Table 1.

Examples of the compound represented by the formula (2) where $R^3$ is an alkyl group having 1 to 3 carbon atoms include the compounds represented by (X-7) to (X-12) in Table 1.

TABLE 1

| Exemplary compound | Name of compound |
|---|---|
| (X-1) | N-2-(Aminoethyl)-3-aminopropyltrimethoxysilane |
| (X-2) | 3-Aminopropyltriethoxysilane |
| (X-3) | (Phenylaminomethyl)trimethoxysilane |
| (X-4) | N-2-(Aminoethyl)-3-aminoisobutyltrimethoxysilane |
| (X-5) | N-Ethylaminoisobutyltriethoxysilane |
| (X-6) | N-Methylaminopropyltrimethoxysilane |
| (X-7) | N-2-(Aminoethyl)-3-aminopropylmethyldimethoxysilane |
| (X-8) | 3-Aminopropylmethyldiethoxysilane |
| (X-9) | (Phenylaminomethyl)methyldimethoxysilane |
| (X-10) | N-2-(Aminoethyl)-3-aminoisobutylmethyldimethoxysilane |

TABLE 1-continued

| Exemplary compound | Name of compound |
|---|---|
| (X-11) | N-Ethylaminoisobutylmethyldiethoxysilane |
| (X-12) | N-Methylaminopropylmethyldimethoxysilane |

Among these compounds, bifunctional compounds (bifunctional aminosilane coupling agents) in which $R^3$ is an alkyl group having 1 to 3 carbon atoms are more preferable from the standpoint of the effect of suppressing a variation in the light-area potential in repeated use.

The ratio of the content of the surface-treated zinc oxide particles to the content of the urethane resin is preferably 2:1 to 4:1 (mass ratio). When the mass ratio is 2:1 to 4:1, a variation in the light-area potential in repeated use is sufficiently suppressed, and furthermore, the formation of cracks in the undercoat layer can also be sufficiently suppressed.

As for a method of producing zinc oxide particles, various known production processes can be employed as long as zinc oxide particles having a specific surface area of 14 or more and 25 or less can be produced. For example, zinc oxide particles produced by the French process or the American process may be used. The French process is a production method in which metallic zinc is heated to form zinc vapor, and the zinc vapor is oxidized and is then cooled. The American process is a production method in which zinc ores are heated with a reducing agent to reduce and volatilize the zinc ores, and the resulting metal vapor is then oxidized with air. Alternatively, it is also possible to use zinc oxide particles produced by a wet process that includes calcining zinc hydroxide or basic zinc carbonate obtained by a reaction between a soluble zinc (such as zinc chloride or zinc sulfate) and an alkaline solution (such as an aqueous sodium hydroxide solution) in the form of a precipitate.

In the present invention, the specific surface area of zinc oxide particles can be measured by the following method. The specific surface area (BET value) of zinc oxide particles can be measured using, for example, TriStar 3000 manufactured by Shimadzu Corporation. Specifically, 200 mg of zinc oxide particles are put in a glass cell for measurement. A pretreatment is conducted by drying this cell at 150° C. for 30 minutes in a vacuum, and the cell is then attached to the apparatus to measure the specific surface area.

The urethane resin contained in the undercoat layer is a cured product of an isocyanate (a compound having an isocyanate group) and a polyol resin.

Examples of the isocyanate include 2,4-tolylene diisocyanate, 2,6-tolylene diisocyanate, diphenylmethane-4,4'-diisocyanate, hexamethylene diisocyanate, adducts type of hexamethylene diisocyanate and trimethylolpropane, biuret type of hexamethylene diisocyanate, and isocyanurate type of hexamethylene diisocyanate. The isocyanate is preferably a blocked (stabilized) isocyanate. Examples of the blocked isocyanate include compounds produced by blocking any of the above isocyanates with an oxime. Examples of the oxime include, but are not limited to, acetaldoxime, methylethylketoxime, and cyclohexanone oxime.

Examples of the polyol resin include polyvinyl acetal resins and polyphenol resins. In particular, polyvinyl acetal resins are preferable.

Figure 2:
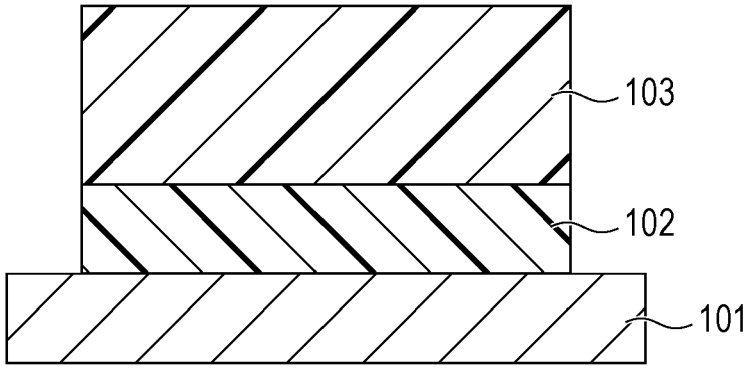
FIG. 2 is a cross-sectional view illustrating a layer structure of an electrophotographic photosensitive member according to an embodiment of the present invention.

Next, the structure of an electrophotographic photosensitive member will be described. For example, as illustrated in FIG. 2, an electrophotographic photosensitive member includes a support 101, an undercoat layer 102 provided on the support 101, and a photosensitive layer 103 provided on the undercoat layer 102.

Examples of the photosensitive layer include a single-layer photosensitive layer that contains a charge-transporting substance and a charge-generating substance therein, and a laminated (function-separated) photosensitive layer that separately includes a charge generation layer containing a charge-generating substance and a charge transport layer containing a charge-transporting substance. In the present invention, such a laminated photosensitive layer is desirable. Among laminated photosensitive layers, a photosensitive layer in which a charge generation layer and a charge transport layer are stacked from the support side in that order is desirable.

Any support having conductivity (conductive support) may be used. For example, a support composed of a metal (or an alloy) such as aluminum, an aluminum alloy, or stainless steel can be used. Examples of the shape of the support include a cylindrical shape and a belt shape. The shape of the support is preferably a cylindrical shape. In order to improve durability of the electrophotographic photosensitive member, a protective layer may be formed on the photosensitive member.

Support

The support is a support having conductivity (conductive support). Examples of the material of the support include metals and alloys such as aluminum, stainless steel, copper, nickel, and zinc. In the case where the support is composed of aluminum or an aluminum alloy, an ED tube, an EI tube, or a support obtained by subjecting one of these tubes to cutting, electrolytic composite polishing (electrolysis performed using an electrode and an electrolyte solution, each of which has an electrolytic action, and polishing with grinding stones having a polishing action), or a wet or dry honing treatment may also be used. Examples of the support further include metal supports and resin supports that have a thin film composed of a conductive material such as aluminum, an aluminum alloy, or an indium oxide-tin oxide alloy thereon.

In order to suppress interference fringes formed by scattering of a laser beam and the like, a cutting treatment, a surface-roughening treatment, an alumite treatment, or the like may be performed on the surface of the support.

Furthermore, a conductive layer may be provided between the support and the undercoat layer in order to, for example, suppress interference fringes formed by scattering of a laser beam and to cover scratches on the support.

The conductive layer can be formed by dispersing conductive particles such as carbon black, metal particles, or metal oxide particles and a binder resin in a solvent to prepare a conductive layer coating solution, applying the conductive layer coating solution onto a support, and drying the resulting coat by heating (thermally curing the resulting coat).

Examples of the binder resin used in the conductive layer include polyester resins, polycarbonate resins, polyvinyl butyral resins, acrylic resins, silicone resins, epoxy resins, melamine resins, urethane resins, phenolic resins, and alkyd resins.

Examples of the solvent used in the conductive layer coating solution include ether solvents, alcohol solvents, ketone solvents, and aromatic hydrocarbon solvents. The thickness of the conductive layer is preferably 5 μm or more and 40 μm or less, and more preferably 10 μm or more and 30 μm or less.

Undercoat Layer

An undercoat layer is provided between a support or a conductive layer and a photosensitive layer (charge generation layer).

The undercoat layer can be formed by heat-drying a coat of an undercoat layer coating solution containing a polyol resin, an isocyanate, and zinc oxide particles whose surfaces have been treated with a compound represented by the formula (2). Zinc oxide particles whose surfaces have been treated with the compound represented by the formula (2) so as to satisfy the formula (1) are used as the surface-treated zinc oxide particles.

The undercoat layer coating solution can be prepared by conducting a dispersion treatment of a polyol resin, an isocyanate, zinc oxide particles, a compound represented by the formula (2), and a solvent so as to satisfy the formula (1).

Examples of the dispersion method include methods using a homogenizer, an ultrasonic dispersion device, a ball mill, a sand mill, a roll mill, a vibration mill, an attritor, or a liquid-collision-type high-speed dispersion device.

The undercoat layer may further contain additives. For example, the undercoat layer may contain known substances such as a metal powder, e.g., an aluminum powder, a conductive substance, e.g., carbon black, an electron-transporting substance, a condensed polycyclic compound, an electron-transporting pigment, a metal chelate compound, and an organometallic compound. Examples of the preferred electron-transporting substance include benzophenone compounds having a hydroxy group and anthraquinone compounds having a hydroxy group.

Examples of the solvent used in the undercoat layer coating solution include organic solvents such as alcohols, sulfoxides, ketones, ethers, esters, aliphatic halogenated hydrocarbons, and aromatic compounds. Alcohol solvents and ketone solvents are preferably used in the present invention.

In order to, for example, adjust the surface roughness of the undercoat layer and to suppress the formation of cracks in the undercoat layer, organic resin particles and a leveling agent may further be incorporated in the undercoat layer. Examples of the organic resin particles include hydrophobic organic resin particles such as silicone particles and hydrophilic organic resin particles such as cross-linked poly(methyl methacrylate) (PMMA) particles. Cross-linked poly(methyl methacrylate) particles, which are hydrophilic organic resin particles, are preferably used in the present invention. In this case, a variation in the light-area potential in repeated use can be more effectively suppressed.

The surface roughness of the undercoat layer can be adjusted by incorporating the organic resin particles in the undercoat layer. Regarding the preferable surface roughness of the undercoat layer, a surface roughness Rz of the undercoat layer is in the range of 0.6 μm or more and 2.0 μm or less, and a surface roughness RSm of the undercoat layer is preferably in the range of 0.010 mm or more and 0.024 mm or less. In particular, when the surface roughness RSm is within this range, a surface roughness with a very small pitch is formed. Consequently, adhesion with a charge generation layer formed on the undercoat layer is improved, and a variation in the light-area potential in a high-humidity environment can be further improved. Herein, the surface roughness Rz (μm) represents an average height (ten-point mean roughness) of five highest peaks and five lowest valleys in each reference length of a roughness curve obtained by measuring the surface roughness of an undercoat layer. The surface roughness RSm (mm) represents an average value of the interval of one period from a peak to a valley adjacent thereto (mean interval between a projection and a depression), the interval being determined from intersection points at which a roughness curve obtained by measuring the surface roughness intersects with a mean line. Note that Rz and RSm are determined by the methods of measurement specified in JIS B0601:2001 (ISO 4287:1997).

From the standpoint of further suppressing a change in the light-area potential, in the case where the conductive layer is provided, the thickness of the undercoat layer is preferably 0.5 μm or more and 10 μm or less, and more preferably 2 μm or more and 8 μm or less. In the case where the conductive layer is not provided, the thickness of the undercoat layer is preferably 10 μm or more and 40 μm or less, and more preferably 15 μm or more and 25 μm or less.

Photosensitive Layer

A photosensitive layer (including a charge generation layer and a charge transport layer) is formed on the undercoat layer.

Examples of the charge-generating substance used in the present invention include azo pigments, phthalocyanine pigments, indigo pigments, perylene pigments, polycyclic quinone pigments, squarylium dyes, thiapyrilium salts, triphenylmethane dyes, quinacridone pigments, azulenium salt pigments, cyanine dyes, anthanthrone pigments, pyranthrone pigments, xanthene dyes, quinoneimine dyes, and styryl dyes. These charge-generating substances may be used alone or in combination of two or more substances. From the standpoint of the sensitivity, among these charge-generating substances, oxytitanium phthalocyanine, chlorogallium phthalocyanine, and hydroxygallium phthalocyanine are preferable. Furthermore, among hydroxygallium phthalocyanines, a hydroxygallium phthalocyanine crystal having a crystal form with strong peaks at Bragg angles 2θ of 7.4°±0.3° and 28.2°±0.3° in a CuKα characteristic X-ray diffraction are preferable.

In the embodiments of the present invention, the measurement of the X-ray diffraction is conducted using a CuKα line under the following conditions:

Measuring device: Fully automatic X-ray diffractometer MXP18, manufactured by Mac Science Co., Ltd.
X-ray tube: Cu
Tube voltage: 50 kV
Tube current: 300 mA
Scanning method: 2θ/θ scan
Scanning speed: 2 deg./min
Sampling interval: 0.020 deg.
Start angle (2θ): 5 deg.
Stop angle (2θ): 40 deg.
Divergence slit: 0.5 deg.
Scattering slit: 0.5 deg.
Receiving slit: 0.3 deg.
A bent monochromator was used.

In the case of a laminated photosensitive layer, examples of the binder resin used in the charge generation layer include polycarbonate resins, polyester resins, butyral resins, polyvinyl acetal resins, acrylic resins, vinyl acetate resins, and urea resins. Among these resins, butyral resins are preferable. These binder resins may be used alone or as a mixture or a copolymer.

The charge generation layer can be formed by dispersing a charge-generating substance and a binder resin in a solvent to prepare a charge generation layer coating solution, applying the coating solution, and drying the resulting coat. Alternatively, the charge generation layer may be an evaporated film of a charge-generating substance.

Examples of the dispersion method include methods using a homogenizer, an ultrasonic dispersion device, a ball mill, a sand mill, a roll mill, or an attritor.

The ratio of the charge-generating substance to the binder resin in the charge generation layer is preferably 0.3 parts by mass or more and 10 parts by mass or less of the charge-generating substance relative to 1 part by mass of the binder resin.

Examples of the solvent used in the charge generation layer coating solution include alcohol solvents, sulfoxide solvents, ketone solvents, ether solvents, ester solvents, and aromatic hydrocarbon solvents. The thickness of the charge generation layer is preferably 0.01 μm or more and 5 μm or less, and more preferably 0.1 μm or more and 2 μm or less.

A sensitizer, an antioxidant, an ultraviolet absorber, a plasticizer, and the like may be optionally added to the charge generation layer.

In an electrophotographic photosensitive member including a laminated photosensitive layer, a charge transport layer is formed on the charge generation layer.

Examples of the charge-transporting substance used in the present invention include triarylamine compounds, hydrazone compounds, styryl compounds, stilbene compounds, and butadiene compounds. These charge-transporting substances may be used alone or in combinations of two or more substances. Among these charge-transporting substances, triarylamine compounds are preferable from the standpoint of the charge mobility.

In the case of a laminated photosensitive layer, examples of the binder resin used in the charge transport layer include acrylic resins, acrylonitrile resins, allyl resins, alkyd resins, epoxy resins, silicone resins, phenolic resins, phenoxy resins, polyacrylamide resins, polyamide-imide resins, polyamide resins, polyallyl ether resins, polyarylate resins, polyimide resins, polyurethane resins, polyester resins, polyethylene resins, polycarbonate resins, polysulfone resins, polyphenylene oxide resins, polybutadiene resins, polypropylene resins, and methacrylic resins. Among these binder resins, polyarylate resins and polycarbonate resins are preferable. These binder resins may be used alone or as a mixture or a copolymer.

The ratio of the charge-transporting substance to the binder resin in the charge transport layer is preferably 0.3 parts by mass or more and 10 parts by mass or less of the charge-transporting substance relative to 1 part by mass of the binder resin. From the standpoint of suppressing cracks in the charge transport layer, the drying temperature is preferably 60° C. or higher and 150° C. or lower, and more preferably 80° C. or higher and 120° C. or lower. The drying time is preferably 10 minutes or more and 60 minutes or less.

The charge transport layer can be formed by dissolving a charge-transporting substance and a binder resin in a solvent to prepare a charge transport layer coating solution, applying the coating solution, and drying the resulting coat.

Examples of the solvent used in the charge transport layer coating solution include alcohol solvents, sulfoxide solvents, ketone solvents, ether solvents, ester solvents, and aromatic hydrocarbon solvents.

In the case where the charge transport layer is a single layer, the thickness of the charge transport layer is preferably 5 μm or more and 40 μm or less, and more preferably 8 μm or more and 30 μm or less. In the case where the charge transport layer has a laminated structure, a charge transport layer on the support side is preferably 5 μm or more and 30 μm or less, and a charge transport layer on the surface side is preferably 1 μm or more and 10 μm or less.

An antioxidant, an ultraviolet absorber, a plasticizer, and the like may be optionally added to the charge transport layer.

In the present invention, a protective layer may be provided on the charge transport layer for the purpose of, for example, improving durability and cleanability.

The protective layer can be formed by dissolving a resin in an organic solvent to prepare a protective layer coating solution, applying the coating solution, and drying the resulting coat. Examples of the resin used in the protective layer include polyvinyl butyral resins, polyester resins, polycarbonate resins, polyamide resins, polyimide resins, polyarylate resins, polyurethane resins, styrene-butadiene copolymers, styrene-acrylic acid copolymers, and styrene-acrylonitrile copolymers.

In order to provide a charge-transporting capability to the protective layer, the protective layer may be formed by curing a monomer material having a charge-transporting capability or a polymer-type charge-transporting substance by using a cross-linking reaction. In particular, it is desirable to form a layer cured by polymerization or cross-linking of a charge-transporting compound having a chain-polymerizable functional group. Examples of the chain-polymerizable functional group include an acrylic group, a methacrylic group, an alkoxysilyl group, and an epoxy group. Examples of the curing reaction include radical polymerization, ionic polymerization, thermal polymerization, photopolymerization, radiation polymerization (electron-beam polymerization), plasma-enhanced CVD, and photo-assisted CVD.

Furthermore, conductive particles, an ultraviolet absorber, a wear-resistance improver, and the like may be optionally added to the protective layer. As for the conductive particles, metal oxide particles such as tin oxide particles are preferable. Examples of the wear-resistance improver include fluorine-atom-containing resin particles such polytetrafluoroethylene particles, alumina particles, and silica particles.

The thickness of the protective layer is preferably 0.5 μm or more and 20 μm or less, and more preferably 1 μm or more and 10 μm or less.

In applying the coating solutions for forming the respective layers, for example, an application method such as a dip application method (dip coating method), a spray coating method, a spinner coating method, a roller coating method, a Meyer bar coating method, or a blade coating method can be employed.

Electrophotographic Apparatus

FIG. 1 illustrates an example of a schematic structure of an electrophotographic apparatus including a process cartridge having an electrophotographic photosensitive member according to an embodiment of the present invention.

In FIG. 1, a cylindrical electrophotographic photosensitive member 1 is rotated around a shaft 2 in the direction indicated by the arrow at a predetermined peripheral speed. While the electrophotographic photosensitive member 1 is rotated, the surface of the electrophotographic photosensitive member 1 is uniformly charged to a certain negative potential by a charging device (primary charging device: for example, a charging roller) 3. Next, the surface receives exposure light (image exposure light) 4, the intensity of which is modulated in accordance with a time-series electrical digital image signal of a target image information, the exposure light 4 being output from an exposure device (not shown) of a slit exposure, a laser beam scanning exposure, or the like. Thus, an electrostatic latent image corresponding to a target image is sequentially formed on the surface of the electrophotographic photosensitive member 1.

The electrostatic latent image formed on the surface of the electrophotographic photosensitive member 1 is developed with a toner contained in a developer in a developing device 5 by reversal development and becomes a toner image. Next, the toner image formed and carried on the surface of the electrophotographic photosensitive member 1 is sequentially transferred to a transfer material (such as paper) P by a transfer bias from a transferring device (such as a transfer roller) 6. In this process, the transfer material P is taken out from a transfer material feeding device (not shown) in synchronization with the rotation of the electrophotographic photosensitive member 1 and fed into a portion (contact portion) between the electrophotographic photosensitive member 1 and the transferring device 6. A bias voltage having a reverse polarity to the charge polarity of the toner is applied from a bias power supply (not shown) to the transferring device 6.

The transfer material P to which the toner image has been transferred is separated from the surface of the electrophotographic photosensitive member 1 and conveyed to a fixing device 8 where the transfer material P is subjected to a fixing process of the toner image. Thus, the transfer material P is conveyed as an image-formed product (print or copy) to the outside of the apparatus.

The developer remaining after transfer (remaining untransferred toner) on the surface of the electrophotographic photosensitive member 1, from which the toner image has been transferred, is removed by a cleaning device (such as a cleaning blade) 7 so that the surface is cleaned. Subsequently, the surface of the electrophotographic photosensitive member 1 is subjected to a charge eliminating treatment by pre-exposure light (not shown) from a pre-exposure device (not shown), and is then repeatedly used for image formation. Note that, in the case where the charging device 3 is a contact charging device using a charging roller or the like as illustrated in FIG. 1, pre-exposure is not necessarily performed.

In the present invention, a plurality of components selected from components such as the electrophotographic photosensitive member 1, the charging device 3, the developing device 5, the transferring device 6, the cleaning device 7, etc. may be installed in a container and integrally supported to form a process cartridge. This process cartridge may be configured so as to be detachably mounted to the main body of an electrophotographic apparatus, such as a copying machine or a laser beam printer. In FIG. 1, the electrophotographic photosensitive member 1, the charging device 3, the developing device 5, and the cleaning device 7 are integrally supported to form a cartridge, and the cartridge functions as a process cartridge 9 that is detachably mounted to the main body of the electrophotographic apparatus using a guiding device 10, such as a rail of the main body of the electrographic apparatus.

In the case where the electrophotographic apparatus is a copying machine or a printer, the exposure light 4 is reflected light or transmitted light from an original. Alternatively, the exposure light 4 is light radiated by, for example, scanning of a laser beam in accordance with a signal obtained by reading an original by a sensor, driving of an LED array, or driving of a liquid-crystal shutter array.

EXAMPLES

The present invention will now be described in more detail by way of specific Examples, but the present invention is not limited thereto. Note that the term "part" in Examples represents "part by mass".

Example 1

An aluminum cylinder having a diameter of 30 mm and a length of 357.5 mm was used as a support.

Next, 100 parts of zinc oxide particles (specific surface area: 14 $m^2/g$, powder resistance: $4.7\times10^6$ Ω·cm) were mixed with 500 parts of toluene under stirring. Subsequently, 0.2 parts of the exemplary compound represented by (X-1) in Table 1 (compound name: N-2-(Aminoethyl)-3-aminopropyltrimethoxysilane, trade name: KBM603, manufactured by Shin-Etsu Chemical Co., Ltd.) was added thereto, and the resulting mixture was stirred for 6 hours. Subsequently, toluene was distilled off under a reduced pressure, and the resulting product was dried by heating at 130° C. for 6 hours. Thus, surface-treated zinc oxide particles were obtained. The ratio of the mass of the exemplary compound represented by (X−1) to the mass of the zinc oxide particles is 0.20% by mass. Accordingly, the amount of surface treatment (A/B) of the zinc oxide particles is A/B=0.20/14=0.014.

Next, 15 parts of a polyvinyl acetal resin (trade name: BM-1, manufactured by Sekisui Chemical Co., Ltd.) serving as a polyol resin and 15 parts of a blocked isocyanate (trade name: Sumidur 3175, manufactured by Sumika Bayer Urethane Co., Ltd.) were dissolved in a mixed solution of 73.5 parts of methyl ethyl ketone and 73.5 parts of 1-butanol. Next, 81 parts of the surface-treated zinc oxide particles and 0.8 parts of 1,2-dihydroxyanthraquinone (manufactured by Tokyo Chemical Industry Co., Ltd.) were added to the resulting liquid, and the liquid was dispersed with a sand mill device using glass beads having a diameter of 0.8 mm in an atmosphere at 23° C.±3° C. for three hours. After the dispersion treatment, 0.01 parts of silicone oil (trade name: SH28PA, manufactured by Dow Corning Toray Co., Ltd.) and 5.6 parts of cross-linked poly(methyl methacrylate) (PMMA) particles (trade name: TECHPOLYMER SSX-102, manufactured by Sekisui Plastics Co., Ltd, average primary particle diameter: 2.5 μm) serving as organic resin particles were added thereto and the resulting mixture was stirred. Thus, an undercoat layer coating solution was prepared. The content of the PMMA particles relative to the solid content of the undercoat layer coating solution is 5% by mass.

This undercoat layer coating solution was applied onto the support by dipping. The resulting coat was dried at 160° C. for 40 minutes to form an undercoat layer having a thickness of 20 μm. The surface roughness of this undercoat layer was measured under the conditions below. According to the results, Rz was 1.1 μm and RSm was 0.016 mm, as shown in Table 3.

Measurement Conditions for Surface Roughness of Undercoat Layer

The measurement of Rz and Rsm of the surface roughness was conducted using a surface roughness measuring device SE-3400 manufactured by Kosaka Laboratory Ltd. The measurement was conducted by scanning the surface of the prepared undercoat layer in a central portion of the aluminum cylinder in the longitudinal (long axis) direction in accordance with JIS B0601:2001 (ISO 4287:1997).

Next, 4 parts of a hydroxygallium phthalocyanine crystal (charge-generating substance) having a crystal form with strong peaks at Bragg angles 2θ±0.2° of 7.4° and 28.1° in a CuKα characteristic X-ray diffraction and a 0.04 parts of a compound represented by a structural formula (A) below were added to a solution prepared by dissolving 2 parts of a polyvinyl butyral resin (trade name: S-LEC BX-1, manufactured by Sekisui Chemical Co., Ltd.) in 100 parts of cyclohexanone. The resulting mixture was dispersed with a sand mill device using glass beads having a diameter of 1 mm in an atmosphere at 23° C.±3° C. for one hour. After the dispersion treatment, 100 parts of ethyl acetate was added thereto. Thus, a charge generation layer coating solution was prepared. This charge generation layer coating solution was applied onto the undercoat layer by dipping, and the resulting coat was dried at 90° C. for 10 minutes to form a charge generation layer having a thickness of 0.20 μm.

[Chem. 3]

(A)

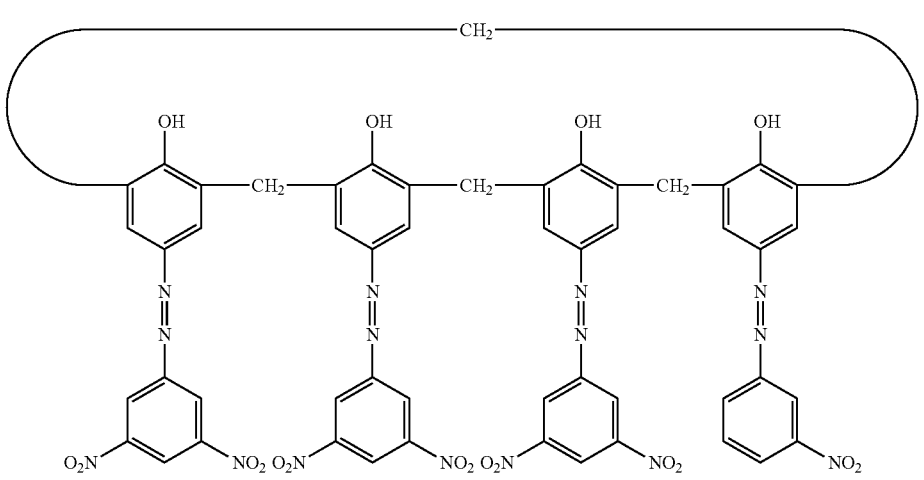

Next, 50 parts of an amine compound (charge-transporting substance) represented by a structural formula (B) below, 50 parts of an amine compound (charge-transporting substance) represented by a structural formula (C) below, and 100 parts of a polycarbonate resin (trade name: Iupilon Z400, manufactured by Mitsubishi Gas Chemical Company, Inc.) were dissolved in a mixed solvent of 650 parts of chlorobenzene and 150 parts of dimethoxymethane. Thus, a charge transport layer coating solution was prepared. After this charge transport layer coating solution became uniform, the coating solution was left to stand for one day. The charge transport layer coating solution was then applied onto the charge generation layer by dipping, and the resulting coat was dried at 110° C. for 30 minutes. Thus, a charge transport layer having a thickness of 21 μm was formed.

[Chem. 4]

(B)

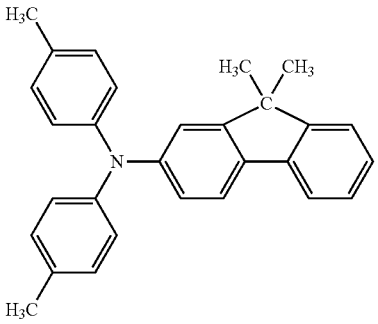

(C)

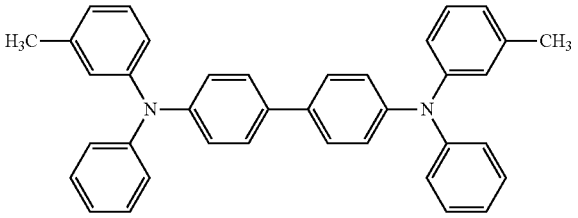

Next, 45 parts of a compound represented by a structural formula (D) below and 55 parts of n-propanol were charged in an ultrahigh-pressure dispersion device, and subjected to a dispersion treatment. Thus, a protective layer coating solution (second charge transport layer coating solution) was prepared.

[Chem. 5]

(D)

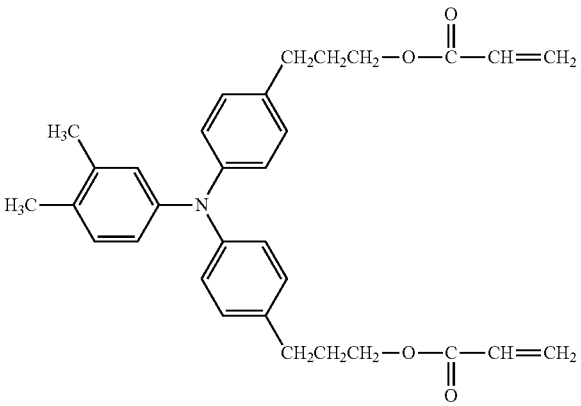

This protective layer coating solution was applied onto the charge transport layer by dipping, and the resulting coat was dried at 50° C. for five minutes. After the drying, the coat was irradiated with an electron beam in a nitrogen atmosphere at an accelerating voltage of 70 kV and at an absorbed dose of 8,000 Gy for 1.6 seconds while rotating the support. Subsequently, heat treatment was conducted in a nitrogen atmosphere for three minutes under the condition that the temperature of the coat was 130° C. The oxygen concentration from the irradiation of the electron beam to the three-minute heat treatment was 20 ppm. Next, heat treatment was conducted in air for 30 minutes under the condition that the temperature of the coat was 100° C. Thus, a protective layer having a thickness of 5 μm was formed.

Thus, an electrophotographic photosensitive member in which the undercoat layer, the charge generation layer, the charge transport layer, and the protective layer were disposed on the support in that order was produced.

Examples 2 to 29

Electrophotographic photosensitive members were produced as in Example 1 except that the ratio of the mass of the compound having the structure represented by the formula (2) and the specific surface area of the zinc oxide particles in Example 1 were changed as shown in Table 3. For reference, Table 2 shows the specific surface area and the powder resistance of various zinc oxide particles used in Examples and Comparative Examples.

TABLE 2

| Specific surface area ($m^2/g$) | Powder resistance ($\Omega \cdot cm$) |
|---|---|
| 14 | $4.7 \times 10^7$ |
| 15 | $2.0 \times 10^7$ |
| 16 | $4.7 \times 10^7$ |
| 17 | $5.2 \times 10^6$ |
| 18 | $4.0 \times 10^6$ |
| 19 | $4.7 \times 10^6$ |
| 20 | $2.3 \times 10^7$ |
| 21 | $2.5 \times 10^7$ |
| 22 | $2.3 \times 10^7$ |
| 23 | $3.0 \times 10^7$ |
| 24 | $2.1 \times 10^7$ |
| 25 | $2.2 \times 10^7$ |

Examples 30 to 33

Electrophotographic photosensitive members were produced as in Example 13 except that the average primary particle diameter of the PMMA particles used for preparation of the undercoat layer coating solution in Example 13 was changed as shown in Table 4.

Examples 34 and 35

Electrophotographic photosensitive members were produced as in Example 1 except that the ratio of the mass of the compound having the structure represented by the formula (2), the specific surface area of the zinc oxide particles, and the content of the PMMA particles in Example 1 were changed as shown in Table 4.

Examples 36 and 37

Electrophotographic photosensitive members were produced as in Example 13 except that the organic resin particles were changed from the PMMA particles in Example 13 to silicone resin particles (trade name: TOSPEARL 145, manufactured by Momentive Performance Materials Inc., average primary particle diameter: 4.5 μm) and the content of the resin particles was changed as shown in Table 4.

Example 38

An electrophotographic photosensitive member was produced as in Example 13 except that the organic resin particles were changed from the PMMA particles in Example 13 to silicone resin particles (trade name: TOSPEARL 120, manufactured by Momentive Performance Materials Inc., average primary particle diameter: 2.0 μm) and the content of the resin particles was changed as shown in Table 4.

Examples 39 and 40

Electrophotographic photosensitive members were produced as in Example 12 except that the organic resin particles were changed from the PMMA particles in Example 12 to silicone resin particles (trade name: TOSPEARL 145, manufactured by Momentive Performance Materials Inc., average primary particle diameter: 4.5 μm) and the content of the resin particles was changed as shown in Table 4.

Examples 41 and 42

Electrophotographic photosensitive members were produced as in Example 12 except that the organic resin particles were changed from the PMMA particles in Example 12 to silicone resin particles (trade name: TOSPEARL 120, manufactured by Momentive Performance Materials Inc., average primary particle diameter: 2.0 μm) and the content of the resin particles was changed as shown in Table 4.

Examples 43 to 64

Electrophotographic photosensitive members were produced as in Example 1 except that the exemplary compound represented by (X-7) in Table 1 (compound name: N-2-(Aminoethyl)-3-aminopropylmethyldimethoxysilane, trade name: KBM602, manufactured by Shin-Etsu Chemical Co., Ltd.) was used as the compound having the structure represented by the formula (2), the content of the compound, and the specific surface area of the zinc oxide particles were changed as shown in Table 4.

Example 65

An electrophotographic photosensitive member was produced as in Example 53 except that 0.8 parts of 2,3,4-trihydroxybenzophenone (manufactured by Tokyo Chemical Industry Co., Ltd.) was used instead of 1,2-dihydroxyanthraquinone in Example 53.

Example 66

An electrophotographic photosensitive member was produced as in Example 51 except that the charge transport layer coating solution and the protective layer coating solution in Example 51 were changed as follows to form a charge transport layer and a protective layer.

First, 30 parts of the compound represented by the above structural formula (B) (charge-transporting substance), 60 parts of the compound represented by the above structural formula (C) (charge-transporting substance), 10 parts of a compound represented by a structural formula (E), 100 parts of a polycarbonate resin (trade name: Iupilon 2400, manufactured by Mitsubishi Engineering-Plastics Corporation, bisphenol-Z polycarbonate), and 0.02 parts of a polycarbonate (viscosity-average molecular weight Mv: 20,000) having a structural unit represented by a structural formula (F) below were dissolved in a mixed solvent of 600 parts of chlorobenzene and 200 parts of dimethoxymethane. Thus, a charge transport layer coating solution was prepared. This charge transport layer coating solution was applied onto the above-described charge generation layer by dipping to form a coat, and the coat was dried at 100° C. for 30 minutes. Thus, a charge transport layer having a thickness of 21 μm was formed.

[Chem. 6]

(E)

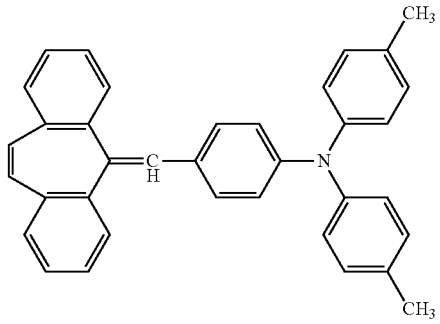

(F)

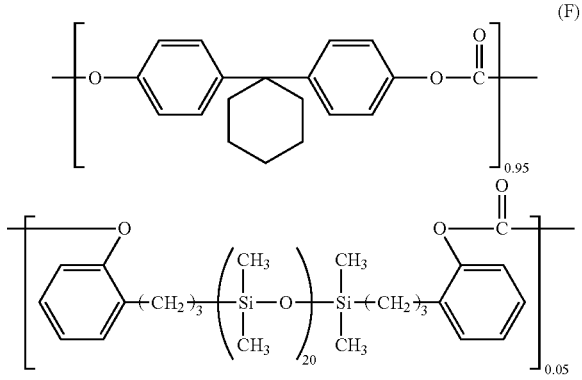

Next, a protective layer coating solution (surface layer coating solution) was applied onto the charge transport layer by the following procedure.

First, 1.5 parts of a fluorine-atom-containing resin (trade name: GF-300, manufactured by Toagosei Co., Ltd.) was dissolved in a mixed solvent of 45 parts of 1,1,2,2,3,3,4-heptafluorocyclopentane (trade name: Zeorora-H, manufactured by Zeon Corporation) and 45 parts of 1-propanol. Subsequently, 30 parts of a fluorinated ethylene resin powder (trade name: Lubron L-2, manufactured by Daikin Industries, Ltd.) was added thereto, and the resulting liquid was passed through a high-pressure dispersion device (trade name: Microfluidizer M-110EH, manufactured by Microfluidics Corporation, USA). Thus, a dispersion liquid was obtained. Subsequently, 70 parts of a hole-transporting compound represented by the formula (D), 30 parts of 1,1,2,2,3,3,4-heptafluorocyclopentane, and 30 parts of 1-propanol were added to the dispersion liquid. The resulting liquid was filtered through a polyflon filter (trade name: PF-040, manufactured by Advantec Toyo Kaisha, Ltd.). Thus, a protective layer coating solution was prepared.

This protective layer coating solution was applied onto the charge transport layer by dipping, and the resulting coat was dried at 50° C. for five minutes. After the drying, the coat was irradiated with an electron beam in a nitrogen atmosphere at an accelerating voltage of 70 kV and at an absorbed dose of 8,000 Gy for 1.6 seconds while rotating the support. Subsequently, heat treatment was conducted in a nitrogen atmosphere for three minutes under the condition that the temperature of the coat was 130° C. The oxygen concentration from the irradiation of the electron beam to the three-minute heat treatment was 20 ppm. Next, heat treatment was conducted in air for 30 minutes under the condition that the temperature of the coat was 100° C. Thus, a protective layer having a thickness of 5 μm was formed.

Comparative Example 1

An electrophotographic photosensitive member was produced as in Example 41 except that zinc oxide particles having a specific surface area of 13 $m^2/g$, a powder resistance of $1.5\times10^6$ Ω·cm, and a purity of 98.9% were used as the zinc oxide particles.

Comparative Examples 2 to 12

Electrophotographic photosensitive members were produced as in Comparative Example 1 except that the content of the aminosilane compound having the structure represented by the formula (2) and the specific surface area of the zinc oxide particles in Comparative Example 1 were changed as shown in Table 5.

Comparative Example 13

An electrophotographic photosensitive member was produced as in Comparative Example 1 except that the organic resin particles were changed from the silicone resin particles in Comparative Example 1 to PMMA particles having an average primary particle diameter of 2.7 μm, and the amount of the silicone resin, the content of the aminosilane compound having the structure represented by the formula (2), and the specific surface area of the zinc oxide particles in Comparative Example 1 were changed as shown in Table 5.

Evaluation of Variation in Light-Area Potential in Repeated Use

An electrophotographic copying machine manufactured by CANON KABUSHIKI KAISHA (trade name: GP405, the electrophotographic copying machine being modified so that the process speed was 300 mm/sec, and including a charging device in which a direct-current voltage superimposed with an alternating-current voltage was applied to a roller-shaped contact charging member (charging roller)) was used as an evaluation apparatus. Each of the electrophotographic photosensitive members of Examples 1 to 66 and Comparative Examples 1 to 13 was attached to a drum cartridge of this evaluation apparatus, and evaluated as described below.

The evaluation apparatus was placed in a high-temperature, high-humidity environment of 30° C./85% RH. Regarding the charging conditions, the alternating-current component applied to the charging roller had a peak-to-peak voltage of 1,500 V and a frequency of 1,500 Hz, and the direct-current component was −850 V. The exposure conditions were adjusted so that an initial light-area potential (Vla) before repeated use in the case of irradiation of laser exposure light was −200 V.

A surface potential of the electrophotographic photosensitive member was measured as follows. The development cartridge was detached from the evaluation apparatus, and a potential probe (trade name: model 6000B-8, manufactured by TREK Inc.) was fixed to the cartridge. The surface potential was measured using a surface potential meter (model 344, manufactured by TREK Inc.). The potential measurement device includes a potential measuring probe arranged at a development position of the development cartridge. The potential measuring probe was positioned at the center in the axial direction of the electrophotographic photosensitive member, and the gap from the surface of the electrophotographic photosensitive member was set to 3 mm.

Next, the evaluation will be described. Note that, in each of the electrophotographic photosensitive members, the evaluation was performed under the charging conditions and exposure conditions that were initially set.

Each of the produced electrophotographic photosensitive members was left to stand in an environment at a temperature of 30° C. and at a humidity of 85% RH for 72 hours. The development cartridge including the electrophotographic photosensitive member therein was attached to the evaluation apparatus, and the photosensitive member was repeatedly used by passing 50,000 sheets. After the passing of the sheets, the evaluation apparatus was left to stand for five minutes. The development cartridge was then attached to the potential measurement device and the light-area potential (Vlb) after the repeated use was measured. The amount of variation in the light-area potential in the repeated use ($\Delta Vl=|Vlb|-|Vla|$) was calculated. In the above formula, Vla represents the initial light-area potential before the repeated use, and |Vlb| and |Vla| respectively represent the absolute values Vlb and Vla. The evaluation results are shown in Tables 3 to 5.

TABLE 3

| | BET (Value of B) | Aminosilane exemplary compound | Content A (%) | A/B | Organic resin particles (Average primary particle diameter) | Amount of organic resin particles (mass %) | ΔVI (H/H) | Rz (μm) | RSm (mm) |
|---|---|---|---|---|---|---|---|---|---|
| Example 1 | 14 | (X-1) | 0.20 | 0.014 | PMMA (2.5 μm) | 5% | 17 | 1.1 | 0.016 |
| Example 2 | 14 | (X-1) | 0.70 | 0.050 | PMMA (2.5 μm) | 5% | 14 | 1.1 | 0.016 |
| Example 3 | 15 | (X-1) | 0.50 | 0.033 | PMMA (2.5 μm) | 5% | 14 | 1.1 | 0.016 |
| Example 4 | 15 | (X-1) | 0.75 | 0.050 | PMMA (2.5 μm) | 5% | 13 | 1.1 | 0.016 |
| Example 5 | 16 | (X-1) | 0.40 | 0.025 | PMMA (2.5 μm) | 5% | 14 | 1.1 | 0.016 |
| Example 6 | 16 | (X-1) | 0.75 | 0.047 | PMMA (2.5 μm) | 5% | 13 | 1.1 | 0.016 |
| Example 7 | 16 | (X-1) | 0.80 | 0.050 | PMMA (2.5 μm) | 5% | 13 | 1.1 | 0.016 |
| Example 8 | 17 | (X-1) | 0.20 | 0.012 | PMMA (2.5 μm) | 5% | 17 | 1.1 | 0.016 |
| Example 9 | 17 | (X-1) | 0.80 | 0.047 | PMMA (2.5 μm) | 5% | 13 | 1.1 | 0.016 |
| Example 10 | 18 | (X-1) | 0.75 | 0.042 | PMMA (2.5 μm) | 5% | 13 | 1.1 | 0.016 |
| Example 11 | 18 | (X-1) | 0.90 | 0.050 | PMMA (2.5 μm) | 5% | 13 | 1.1 | 0.016 |
| Example 12 | 19 | (X-1) | 0.20 | 0.011 | PMMA (2.5 μm) | 5% | 16 | 1.1 | 0.016 |
| Example 13 | 19 | (X-1) | 0.75 | 0.039 | PMMA (2.5 μm) | 5% | 13 | 1.1 | 0.016 |
| Example 14 | 20 | (X-1) | 0.50 | 0.025 | PMMA (2.5 μm) | 5% | 13 | 1.1 | 0.016 |
| Example 15 | 20 | (X-1) | 0.75 | 0.038 | PMMA (2.5 μm) | 5% | 13 | 1.1 | 0.016 |
| Example 16 | 20 | (X-1) | 1.00 | 0.050 | PMMA (2.5 μm) | 5% | 14 | 1.1 | 0.016 |
| Example 17 | 21 | (X-1) | 0.20 | 0.010 | PMMA (2.5 μm) | 5% | 16 | 1.1 | 0.016 |
| Example 18 | 21 | (X-1) | 0.70 | 0.033 | PMMA (2.5 μm) | 5% | 13 | 1.1 | 0.016 |
| Example 19 | 21 | (X-1) | 0.80 | 0.038 | PMMA (2.5 μm) | 5% | 13 | 1.1 | 0.016 |
| Example 20 | 22 | (X-1) | 0.75 | 0.034 | PMMA (2.5 μm) | 5% | 13 | 1.1 | 0.016 |

TABLE 3-continued

| | BET (Value of B) | Aminosilane exemplary compound | Content A (%) | A/B | Organic resin particles (Average primary particle diameter) | Amount of organic resin particles (mass %) | ΔVI (H/H) | Rz (μm) | RSm (mm) |
|---|---|---|---|---|---|---|---|---|---|
| Example 21 | 22 | (X-1) | 1.10 | 0.050 | PMMA (2.5 μm) | 5% | 14 | 1.1 | 0.016 |
| Example 22 | 23 | (X-1) | 0.30 | 0.013 | PMMA (2.5 μm) | 5% | 17 | 1.1 | 0.015 |
| Example 23 | 23 | (X-1) | 0.8 | 0.035 | PMMA (2.5 μm) | 5% | 13 | 1.1 | 0.015 |
| Example 24 | 24 | (X-1) | 0.6 | 0.025 | PMMA (2.5 μm) | 5% | 13 | 1.1 | 0.015 |
| Example 25 | 24 | (X-1) | 0.75 | 0.031 | PMMA (2.5 μm) | 5% | 13 | 1.1 | 0.015 |
| Example 26 | 24 | (X-1) | 1.2 | 0.050 | PMMA (2.5 μm) | 5% | 14 | 1.1 | 0.015 |
| Example 27 | 25 | (X-1) | 0.3 | 0.012 | PMMA (2.5 μm) | 5% | 17 | 1.1 | 0.015 |
| Example 28 | 25 | (X-1) | 0.9 | 0.036 | PMMA (2.5 μm) | 5% | 13 | 1.1 | 0.015 |
| Example 29 | 25 | (X-1) | 1.2 | 0.048 | PMMA (2.5 μm) | 5% | 14 | 1.1 | 0.015 |

TABLE 4

| | BET (Value of B) | Aminosilane exemplary compound | Content A (%) | A/B | Organic resin particles (Average primary particle diameter) | Amount of organic resin particles (mass %) | ΔVI (H/H) | Rz (μm) | RSm (mm) |
|---|---|---|---|---|---|---|---|---|---|
| Example 30 | 19 | (X-1) | 0.75 | 0.039 | PMMA (3.0 μm) | 5% | 13 | 1.3 | 0.016 |
| Example 31 | 19 | (X-1) | 0.75 | 0.039 | PMMA (3.5 μm) | 5% | 13 | 1.5 | 0.018 |
| Example 32 | 19 | (X-1) | 0.75 | 0.039 | PMMA (4.0 μm) | 5% | 15 | 1.7 | 0.020 |
| Example 33 | 19 | (X-1) | 0.75 | 0.039 | PMMA (1.0 μm) | 5% | 13 | 0.9 | 0.015 |
| Example 34 | 19 | (X-1) | 1.2 | 0.048 | PMMA (2.5 μm) | 6% | 13 | 1.2 | 0.017 |
| Example 35 | 19 | (X-1) | 1.2 | 0.048 | PMMA (2.5 μm) | 4% | 13 | 1 | 0.015 |
| Example 36 | 19 | (X-1) | 0.75 | 0.039 | Silicone resin (4.5 μm) | 3% | 20 | 1.2 | 0.028 |
| Example 37 | 19 | (X-1) | 0.75 | 0.039 | Silicone resin (4.5 μm) | 4% | 22 | 1.3 | 0.028 |
| Example 38 | 19 | (X-1) | 0.75 | 0.039 | Silicone resin (2.0 μm) | 4% | 20 | 1.2 | 0.025 |
| Example 39 | 19 | (X-1) | 0.20 | 0.011 | Silicone resin (4.5 μm) | 3% | 22 | 1.2 | 0.028 |
| Example 40 | 19 | (X-1) | 0.20 | 0.011 | Silicone resin (4.5 μm) | 4% | 23 | 1.3 | 0.028 |
| Example 41 | 19 | (X-1) | 0.20 | 0.011 | Silicone resin (2.0 μm) | 3% | 21 | 1.1 | 0.025 |
| Example 42 | 19 | (X-1) | 0.20 | 0.011 | Silicone resin (2.0 μm) | 4% | 22 | 1.2 | 0.025 |
| Example 43 | 16 | (X-7) | 0.40 | 0.025 | PMMA (2.5 μm) | 5% | 9 | 1.1 | 0.016 |
| Example 44 | 16 | (X-7) | 0.75 | 0.047 | PMMA (2.5 μm) | 5% | 8 | 1.1 | 0.016 |
| Example 45 | 16 | (X-7) | 0.80 | 0.050 | PMMA (2.5 μm) | 5% | 8 | 1.1 | 0.016 |
| Example 46 | 17 | (X-7) | 0.20 | 0.012 | PMMA (2.5 μm) | 5% | 12 | 1.1 | 0.016 |
| Example 47 | 17 | (X-7) | 0.80 | 0.047 | PMMA (2.5 μm) | 5% | 8 | 1.1 | 0.016 |
| Example 48 | 18 | (X-7) | 0.75 | 0.042 | PMMA (2.5 μm) | 5% | 8 | 1.1 | 0.016 |
| Example 49 | 18 | (X-7) | 0.90 | 0.050 | PMMA (2.5 μm) | 5% | 8 | 1.1 | 0.016 |
| Example 50 | 19 | (X-7) | 0.20 | 0.011 | PMMA (2.5 μm) | 5% | 11 | 1.1 | 0.016 |
| Example 51 | 19 | (X-7) | 0.75 | 0.039 | PMMA (2.5 μm) | 5% | 8 | 1.1 | 0.016 |
| Example 52 | 20 | (X-7) | 0.50 | 0.025 | PMMA (2.5 μm) | 5% | 8 | 1.1 | 0.016 |
| Example 53 | 20 | (X-7) | 0.75 | 0.038 | PMMA (2.5 μm) | 5% | 8 | 1.1 | 0.016 |
| Example 54 | 20 | (X-7) | 1.00 | 0.050 | PMMA (2.5 μm) | 5% | 9 | 1.1 | 0.016 |
| Example 55 | 21 | (X-7) | 0.20 | 0.010 | PMMA (2.5 μm) | 5% | 11 | 1.1 | 0.016 |

TABLE 4-continued

| | BET (Value of B) | Aminosilane exemplary compound | Content A (%) | A/B | Organic resin particles (Average primary particle diameter) | Amount of organic resin particles (mass %) | ΔVI (H/H) | Rz (μm) | RSm (mm) |
|---|---|---|---|---|---|---|---|---|---|
| Example 56 | 21 | (X-7) | 0.70 | 0.033 | PMMA (2.5 μm) | 5% | 8 | 1.1 | 0.016 |
| Example 57 | 21 | (X-7) | 0.80 | 0.038 | PMMA (2.5 μm) | 5% | 8 | 1.1 | 0.016 |
| Example 58 | 22 | (X-7) | 0.75 | 0.034 | PMMA (2.5 μm) | 5% | 8 | 1.1 | 0.016 |
| Example 59 | 22 | (X-7) | 1.10 | 0.050 | PMMA (2.5 μm) | 5% | 9 | 1.1 | 0.016 |
| Example 60 | 23 | (X-7) | 0.30 | 0.013 | PMMA (2.5 μm) | 5% | 12 | 1.1 | 0.015 |
| Example 61 | 23 | (X-7) | 0.8 | 0.035 | PMMA (2.5 μm) | 5% | 8 | 1.1 | 0.015 |
| Example 62 | 24 | (X-7) | 0.6 | 0.025 | PMMA (2.5 μm) | 5% | 8 | 1.1 | 0.015 |
| Example 63 | 24 | (X-7) | 0.75 | 0.031 | PMMA (2.5 μm) | 5% | 8 | 1.1 | 0.015 |
| Example 64 | 24 | (X-7) | 1.2 | 0.050 | PMMA (2.5 μm) | 5% | 9 | 1.1 | 0.015 |
| Example 65 | 20 | (X-7) | 0.75 | 0.039 | PMMA (2.5 μm) | 5% | 8 | 1.1 | 0.016 |
| Example 66 | 19 | (X-7) | 0.75 | 0.039 | PMMA (2.5 μm) | 5% | 8 | 1.1 | 0.016 |

TABLE 5

| | BET (Value of B) | Aminosilane exemplary compound | Content A (%) | A/B | Organic resin particles (Average primary particle diameter) | Amount of organic resin particles (mass %) | ΔVI (H/H) | Rz (μm) | RSm (mm) |
|---|---|---|---|---|---|---|---|---|---|
| Comparative Example 1 | 13 | (X-1) | 0.20 | 0.015 | Silicone resin (2.0 μm) | 3% | 32 | 1.1 | 0.025 |
| Comparative Example 2 | 13 | (X-1) | 0.60 | 0.046 | Silicone resin (2.0 μm) | 3% | 30 | 1.1 | 0.025 |
| Comparative Example 3 | 14 | (X-1) | 0.10 | 0.007 | Silicone resin (2.0 μm) | 3% | 28 | 1.1 | 0.025 |
| Comparative Example 4 | 14 | (X-1) | 0.75 | 0.054 | Silicone resin (2.0 μm) | 3% | 28 | 1.1 | 0.025 |
| Comparative Example 5 | 15 | (X-1) | 0.80 | 0.053 | Silicone resin (2.0 μm) | 3% | 30 | 1.1 | 0.025 |
| Comparative Example 6 | 20 | (X-1) | 0.10 | 0.005 | Silicone resin (2.0 μm) | 3% | 28 | 1.1 | 0.025 |
| Comparative Example 7 | 21 | (X-1) | 1.10 | 0.052 | Silicone resin (2.0 μm) | 3% | 27 | 1.1 | 0.025 |
| Comparative Example 8 | 25 | (X-1) | 0.20 | 0.008 | Silicone resin (2.0 μm) | 3% | 28 | 1.1 | 0.025 |
| Comparative Example 9 | 25 | (X-1) | 1.30 | 0.052 | Silicone resin (2.0 μm) | 3% | 31 | 1.1 | 0.025 |
| Comparative Example 10 | 26 | (X-1) | 0.30 | 0.012 | Silicone resin (2.0 μm) | 3% | 28 | 1.1 | 0.025 |
| Comparative Example 11 | 26 | (X-1) | 0.75 | 0.029 | Silicone resin (2.0 μm) | 3% | 30 | 1.1 | 0.025 |
| Comparative Example 12 | 26 | (X-1) | 1.20 | 0.046 | Silicone resin (2.0 μm) | 3% | 31 | 1.1 | 0.025 |
| Comparative Example 13 | 19 | (X-1) | 1.50 | 0.066 | PMMA (2.7 μm) | 5% | 28 | 1.1 | 0.015 |

In Tables 3 to 5, the term "BET" represents the specific surface area of zinc oxide particles (the value of B). The term "content A (%)" represents the ratio A (mass %) of the mass of the compound represented by the above formula (2) to the mass of the zinc oxide particles. The symbol "ΔVl(H/H)" represents the amount of variation in the light-area potential in the repeated use of the photosensitive member in the high-temperature, high-humidity environment.

These results show that even when an electrophotographic photosensitive member is repeatedly used for a long time in a high-temperature, high-humidity environment, a variation in the light-area potential can be suppressed by incorporating zinc oxide particles whose surfaces have been treated with a compound represented by the formula (2) so as to satisfy the formula (1) in an undercoat layer of the electrophotographic photosensitive member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-262121, filed Nov. 30, 2011 and No.

2012-254809 filed Nov. 21, 2012, which are hereby incorporated by reference herein in their entirety.

The invention claimed is:

1. An electrophotographic photosensitive member, comprising:

a support;

an undercoat layer formed on the support; and a photosensitive layer formed on the undercoat layer, wherein the undercoat layer comprises:

a urethane resin, and zinc oxide particles whose surfaces have been treated with a compound represented by the following formula (2), when a ratio of the mass of the compound represented by the formula (2) relative to the mass of the zinc oxide particles is A mass %, and a specific surface area of the zinc oxide particles is B $m^2/g$, the amount of surface treatment which is defined as A/B satisfies the following formula (1), and the value of B is from 14 to 25, $$0.010 \leq A/B \leq 0.050 \quad (1), \text{ and}$$

(2)

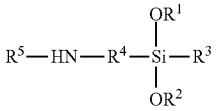

wherein, in the formula (2), $R^1$ and $R^2$ each independently represent an alkyl group having 1 to 3 carbon atoms, $R^3$ represents an alkyl group having 1 to 3 carbon atoms or an alkoxy group having 1 to 3 carbon atoms, $R^4$ represents a bivalent group represented by the following formula (R4-1), (R4-2) or (R4-3), and $R^5$ represents a hydrogen atom, a phenyl group, or an alkyl group having 1 to 3 carbon atoms, and (R4-1)

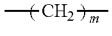

(R4-2)

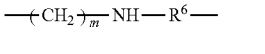

(R4-3)

wherein, in the formulas (R4-1), (R4-2) and (R4-3), m is an integer number selected from 1 to 3, and $R^6$ and $R^7$ each independently represent an alkylene group having 1 to 4 carbon atoms.

2. An electrophotographic photosensitive member according to claim 1, wherein the amount of surface treatment satisfies the following formula (3):

$$0.025 \leq A/B \leq 0.050 \quad (3).$$

3. An electrophotographic photosensitive member according to claim 1, wherein, in the formula (2), $R^3$ is an alkyl group having 1 to 3 carbon atoms.

4. An electrophotographic photosensitive member according to claim 1, wherein the undercoat layer further comprises particles of cross-linked poly(methyl methacrylate).

5. An electrophotographic photosensitive member according to claim 1, wherein the undercoat layer further comprises at least one selected from the group consisting of a benzophenone compound having a hydroxy group, and an anthraquinone compound having a hydroxy group.

6. A method of producing the electrophotographic photosensitive member according to claim 1, wherein the method comprises the following steps of:

forming a coat for the undercoat layer by using an undercoat layer coating solution; and forming the undercoat layer by heat-drying of the coat, and wherein the undercoat layer coating solution comprises:

a compound having one or more isocyanate groups, a polyol resin, and the zinc oxide particles whose surfaces have been treated with the compound represented by the formula (2).

7. A process cartridge detachably attachable to a main body of an electrophotographic apparatus, wherein the process cartridge integrally supports:

the electrophotographic photosensitive member according to claim 1, and at least one device selected from the group consisting of a charging device, a developing device, a transferring device, and a cleaning device.

8. An electrophotographic apparatus comprising:

the electrophotographic photosensitive member according to claim 1;

a charging device;

an exposure device;

a developing device; and a transferring device.

* * * * *